US007740080B2

(12) United States Patent
Fenton

(10) Patent No.: US 7,740,080 B2
(45) Date of Patent: Jun. 22, 2010

(54) PRESSURE ENERGIZED SEAL

(75) Inventor: Stephen P. Fenton, Balmedie (GB)

(73) Assignee: Vetco Gray Inc., Houston, TX (US)

( * ) Notice: Subject to any disclaimer, the term of this patent is extended or adjusted under 35 U.S.C. 154(b) by 234 days.

(21) Appl. No.: 11/945,864

(22) Filed: Nov. 27, 2007

(65) Prior Publication Data

US 2009/0133884 A1 May 28, 2009

(51) Int. Cl.
*F16L 17/00* (2006.01)

(52) U.S. Cl. ..... 166/387; 166/84.1; 166/85.3; 277/605; 277/644

(58) Field of Classification Search ..... 166/387, 166/85.3, 84.1, 84.4; 277/605, 566, 644, 277/648, 619
See application file for complete search history.

(56) References Cited

U.S. PATENT DOCUMENTS

| | | | | |
|---|---|---|---|---|
| 3,337,223 | A * | 8/1967 | Nusbaum | 277/529 |
| 4,030,544 | A | 6/1977 | Ahlstone | |
| 4,702,481 | A | 10/1987 | Brammer | |
| 4,742,874 | A | 5/1988 | Gullion | |
| 4,749,047 | A | 6/1988 | Taylor | |
| 4,766,956 | A | 8/1988 | Smith et al. | |
| 4,771,832 | A | 9/1988 | Bridges | |
| 4,791,987 | A | 12/1988 | Cassity et al. | |
| 4,807,705 | A | 2/1989 | Henderson et al. | |
| 4,911,480 | A | 3/1990 | Bridges et al. | |
| 4,960,172 | A | 10/1990 | Nelson | |
| 5,090,737 | A | 2/1992 | Brammer et al. | |
| 5,224,715 | A | 7/1993 | Downes et al. | |
| 5,240,263 | A * | 8/1993 | Nicholson | 277/614 |
| 5,285,853 | A | 2/1994 | Eckert et al. | |
| 5,307,879 | A | 5/1994 | Kent | |
| 5,456,314 | A | 10/1995 | Boehm, Jr. et al. | |
| 5,464,063 | A | 11/1995 | Boehm, Jr. | |
| 5,997,003 | A * | 12/1999 | Turner | 277/339 |
| 6,250,646 | B1 * | 6/2001 | Chang | 277/603 |
| 6,325,392 | B1 * | 12/2001 | Halling | 277/654 |
| 6,637,750 | B2 * | 10/2003 | Quoiani | 277/339 |
| 6,843,516 | B2 * | 1/2005 | Bishop et al. | 285/420 |
| 6,948,715 | B2 * | 9/2005 | Taylor et al. | 277/603 |
| 6,969,070 | B2 | 11/2005 | Reimert et al. | |
| 7,096,956 | B2 | 8/2006 | Reimert | |
| 7,128,143 | B2 | 10/2006 | Van Bilderbeek | |
| 7,219,738 | B2 | 5/2007 | Reimert | |
| 2008/0265517 | A1 * | 10/2008 | Jennings | 277/328 |

* cited by examiner

*Primary Examiner*—Daniel P Stephenson
(74) *Attorney, Agent, or Firm*—Bracewell & Giuliani

(57) ABSTRACT

A seal for use in sealing on a wellhead assembly, where the seal is pressure energized and comprises an annular element having an inverted portion on its outer portion along its length. The seal may further include upper and lower ring members sandwiching the element between the ring members. The seal is formable by adjoining the open surfaces of two "W" shaped annular seals along their edges thereby forming an element responsive to pressure.

12 Claims, 2 Drawing Sheets

PRESSURE ENERGIZED SEAL

BACKGROUND

1. Field of Invention

The device described herein relates generally to wellhead assemblies, and in particular to provide a pressure seal for use with a wellhead assembly.

2. Description of Related Art

Wellheads used in the production of hydrocarbons extracted from subterranean formations typically comprise a wellhead assembly. Wellhead assemblies are attached at the opening of wellbores that intersect hydrocarbon producing formations. Wellhead assemblies also provide support for casing inserted into the wellbore. The casing lines the wellbore, thereby isolating the wellbore from the surrounding formation. Tubing typically lies concentric within the casing and provides a conduit for producing the hydrocarbons entrained within the formation. Wellhead assemblies also typically include production trees that connect to the upper end of the tubing and distribute the produced fluids. The tubing may be supported by a tubing hanger in the wellhead housing or in the production tree.

Hardware within the wellheads for suspending the tubing and casing is arranged in a concentric arrangement. If the hanger is in the wellhead housing an isolation sub extends between the tubing hanger and a production bore in the production tree. Various seals are employed between the sub and its mating parts.

SUMMARY OF INVENTION

The present disclosure includes a wellhead assembly comprising, a housing, a tubular within the housing, a support shoulder, and a seal assembly disposed between the tubular and the housing where the seal assembly is configured to engage the shoulder. The seal assembly comprises an annular seal having a lower portion, an upper portion an inner side wall and an outer side wall, wherein a portion of the outer surface of the seal is inverted. One of the lower portion or upper portion may be inverted. The wellhead assembly may further comprise a lower support ring formed for mating engagement with the lower portion and an upper support ring for mating engagement with the upper portion. The support rings may include raised portions for engagement with the inverted contours of the portions. Optionally, a vent may be formed through a wall of the annular seal and solid particles may be included in the annular seal. The annular seal is energized into sealing engagement between the tubular and housing in response to pressure applied to its outer surface. The annular seal may be a metal face seal.

Also disclosed herein is a pressure energized seal assembly for sealing between a tubular and a corresponding member. In this embodiment the seal comprises an annular element configured to circumscribe the tubular member, the annular element having an upper portion, a lower inverted portion, and side walls, wherein the lower inverted portion is formed for pressure communication with a pressure source, and wherein pressure applied to the lower inverted portion urges the side walls into sealing engagement with the tubular and the corresponding member, and a supporting shoulder formed for compressive engagement with the upper portion.

A method of sealing between a tubular and a housing in a wellhead assembly is further included herein, the method comprising, forming a shoulder within the wellhead assembly, wherein the shoulder circumscribes the tubular, disposing a seal assembly adjacent the shoulder, wherein the seal assembly comprises an annular sealing element circumscribing the tubular having an axis, an upper portion, an inner side wall, an outer side wall, a lower portion wherein the lower portion is inverted towards the axis, and putting a pressure source in pressure communication with the lower portion thereby imparting a compressive force onto the annular sealing element that outwardly urges the inner side wall into sealing engagement with the tubular and the outer side wall into sealing engagement with the housing.

BRIEF DESCRIPTION OF DRAWINGS

Some of the features and benefits of the present invention having been stated, others will become apparent as the description proceeds when taken in conjunction with the accompanying drawings, in which.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

Figure 1:
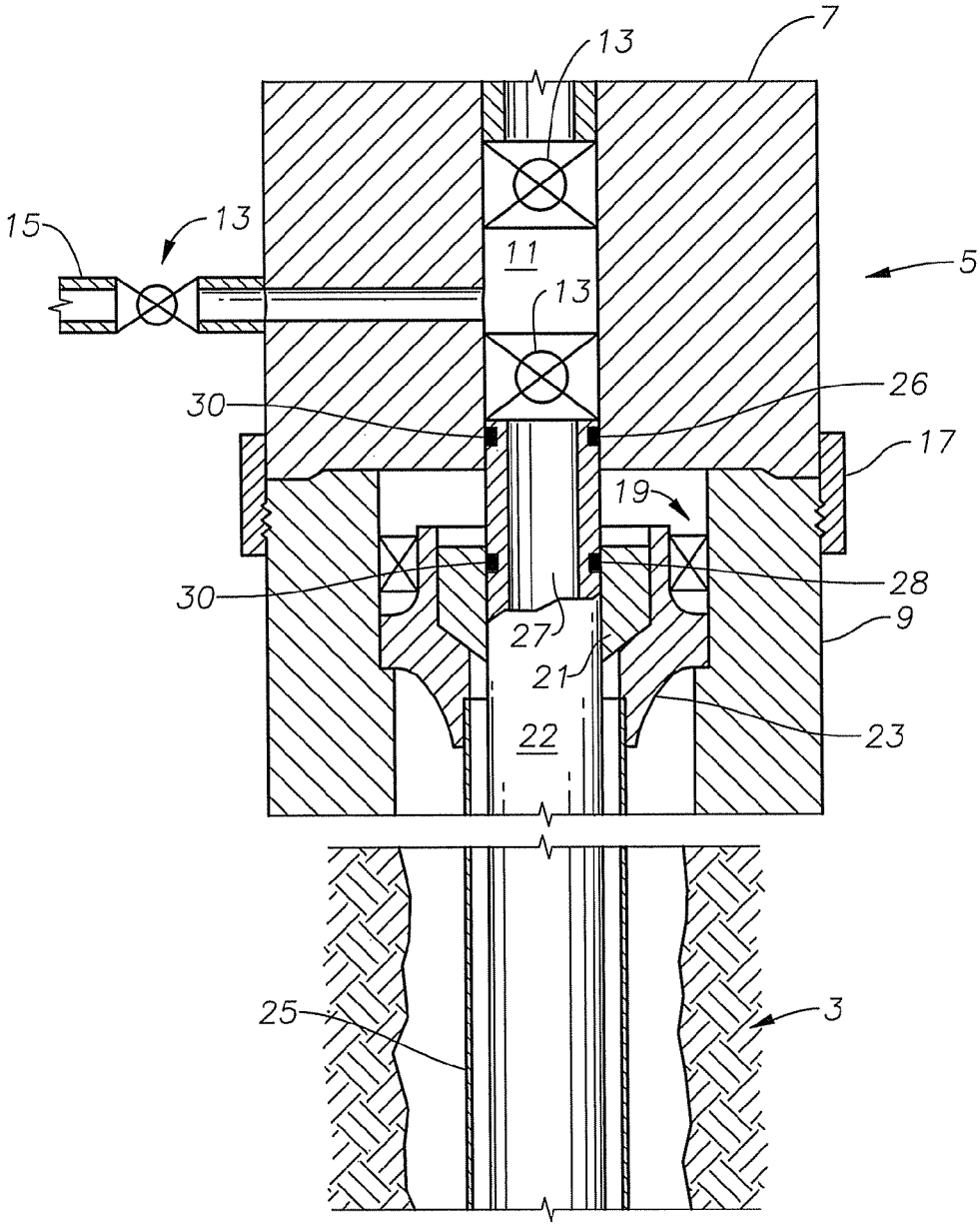
FIG. 1 is a side cross sectional view of an embodiment of a wellhead assembly having a pressure energized seal.

Referring now to FIG. 1, one embodiment of a wellhead assembly having a pressure activated sealing element is provided. FIG. 1 shows a cross sectional view of a wellhead assembly 5 comprising a production tree 7 mounted atop a wellhead housing 9. A production bore 11 is formed within the production tree 7 that provides fluid communication with a production flow outlet 15 extending from the production tree 7. In the embodiment shown, a portion of the production bore 11 extends laterally within the production tree 7 to the production flowline 15. Control valves 13 are provided in the primary portion of the production bore 11 and also on the production outlet 15. Selectively opening and closing the control valves 13 selectively allows wellbore fluid flow through the production outlet 15.

The wellhead housing 9 is attached to the production tree 7 by an external connector 17. Included within the housing 9 are production tubing 22, a tubing hanger 21, and a casing hanger 23. In the embodiment shown, the casing hanger 23, which is a generally annular member, is coaxially secured within a portion of the housing 9 and supports a string of casing cemented in the well. Packoffs 19 (also referred to as casing hanger seals) are disposed between the outer circumference of the casing hanger 23 in a portion of the inner circumference of the housing 9. An inner groove is shown formed within the casing hanger 23 formed to receive the annular tubing hanger 21. Production tubing 22 extends downward from the tubing hanger 21 into the wellbore 3 from within the housing 9.

An annular isolation sleeve 27 coaxially resides within a portion of the production tree 7 on its upper end and extends downward terminating within the upper portion of the tubing hanger 21. Wellbore flow from the production tubing 22 reaches the production bore 11 through the isolation sleeve 27. Examples of seal assemblies 30 are shown circumscribing the isolation sleeve 27 on the sleeve 27 upper end and sleeve 27 lower end. For the purposes of reference and clarity, the term "upper" generally refers to a position closer to the top of the production tree 7, and the term "lower" generally refers to a position closer to the bottom of the wellbore 5.

The seal assembly 30 on the sleeve 27 upper end resides in an upper pocket 26 formed in the sleeve 27. The seal assembly 30 on the sleeve 27 lower end is in a lower pocket 28 formed in the sleeve 27. In the embodiment of FIG. 1, seal assembly 30 provides a sealing function between the outer circumference of the isolation sleeve 27 and surrounding concentric hardware. Optionally the seal assembly 30 can be positioned in other concentric members of the wellhead assembly 5 or multiple seal assemblies 30 may be included within the wellhead assembly 5.

Figure 2:
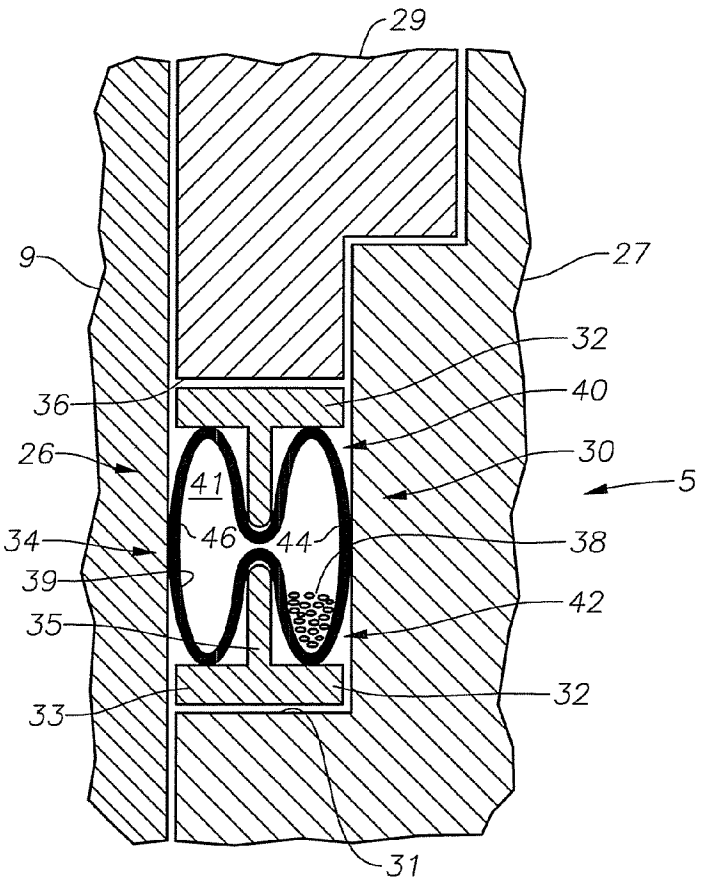
FIG. 2 is a side cross sectional view of an embodiment of a pressure energized seal.

FIG. 2 illustrates one cross-sectional view of an embodiment of a seal assembly 30 for use within a wellhead assembly 5. In this embodiment, the seal element 34 is in a pocket 26 formed by an upward facing shoulder 31 formed on the isolation sleeve 27 and a downward facing shoulder 36 on a threaded retainer ring 29. Optionally and as noted above, the pocket 26 may be formed in any one of a number of the concentric members making up the wellhead assembly 5. The seal assembly 30 of FIG. 2 comprises a seal element 34 in the annular space between a pair of concentric wellhead assembly elements. In the embodiment shown, the seal element 34 is an annular member comprising a metal, elastically deformable outer wall 39 circumscribing an inner hollow space 41. The hollow space 41 does not have to be sealed. The wall 39 forms a pressure harrier around the hollow space 41 whereby applying a force at a first location on the outer surface of the wall 39 causes an outward bulge on the wall 39 at a second location. The wall 39 may be formed from a pliable and elastic metal allowing it to deform under applied force and in some situations return to its original un-deformed shape. Optionally the seal element 34 may be a metal faced seal.

With reference to the specific embodiment illustrated in FIG. 2, the seal element 34 comprises an upper portion 40, a lower portion 42, an outer sidewall 46, and an inner sidewall 44. The outer sidewall 46 is shown in contacting engagement with a wall of the tree production bore 11. The inner wall of the pocket 26 in this embodiment is the isolation sleeve 27, thus, the inner sidewall 44 is illustrated in contact with a cylindrical exterior surface of the isolation sleeve 27. The upper and lower portions 40, 42 of the seal element 34 of FIG. 2 are inverted wherein the mid section of these portions 40, 42 bows inward toward the axis of the seal element 34. Inverting each of the upper and lower portions 40, 42 creates a "W" shaped cross section of these respective portions 40, 42. Inverting the upper and lower portions 40, 42 fashions an inwardly protruding space on the outside of the wall 39 at the upper and lower portions 40, 42.

Thus in one example of use applying a distributed force, such as pressure, at the outer wall 39 where the lower portion 42 is inverted, the upward force on the inverted portion flexes the sidewalls 40, 46 radially inward and outward into contacting and sealing engagement with the respective walls of the pocket 26 between the wall of the tree production bore 11 and the wall of the isolation sleeve 27. In use, normally the upper portion 40 of the seal 34 will be exposed to internal pressure in the tubing 22 via the clearance existing between the end of the isolation sleeve 27 and the tree production bore 11. Since wellbore pressure normally exceeds ambient pressure existing below the seal assembly 30, a pressure differential will form between the lower portion 42 and the upper portion 40. The resulting pressure differential results in a force distribution that energizes the seal assembly 30 into sealing engagement between the isolation sleeve 27 and the tree production bore 11. If a higher pressure occurred on the exterior of the isolation sleeve 27, the reverse would occur with pressure being exerted in the lower seal portion 42.

Figure 3:
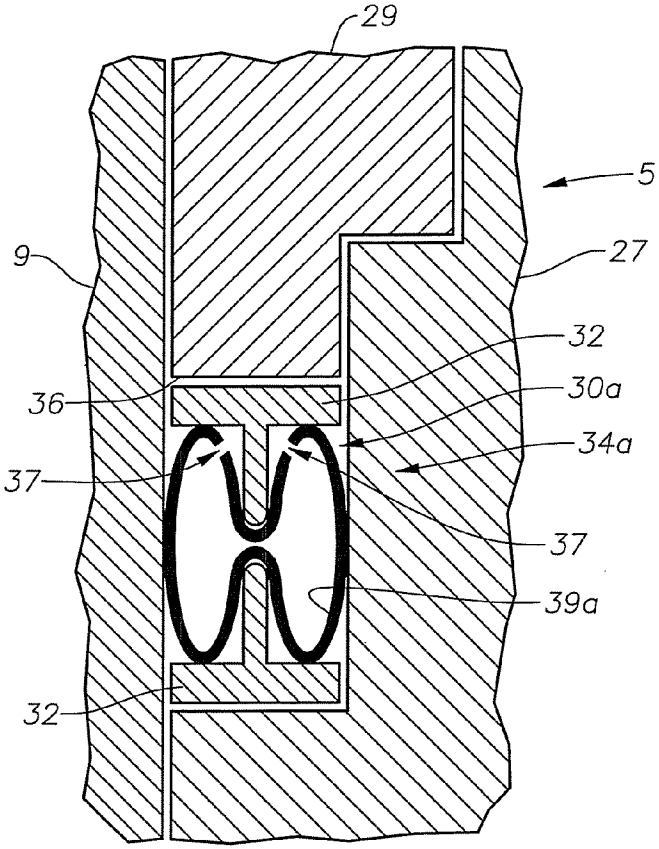
FIG. 3 is a side cross sectional view of another embodiment of a pressure energized seal.

Optionally the seal assembly 30 may further comprise annular rigid conformed members 32 on top. FIGS. 2 and 3 provide a cross sectional view of the conformed members 32. The conformed members comprise a base 33, wherein the base is shown roughly perpendicular to the axis of the wellhead assembly 5. Perpendicularly extending from roughly the middle of the base 33 is a cylindrical vertical member 35 giving each member 32 a "T" shape in cross section. The members 32 include a cylindrical portion that inserts into one of the inverted portions and a cap that contacts one of the shoulders 31 or 36. Conforming members 32 prevent the inverted portion from deflecting excessively when under pressure.

In one optional embodiment, individual solid particles 38 may be included within the inner annulus of the seal 34. These particles 38 provide a structural support to the seal element 34 without hindering the distribution of or transfer of pressure forces throughout the seal element 34, thereby energizing the seal element 34. The diameter of the particles 38 can vary or be substantially homogenous. In one embodiment, the particles 38 comprise a multitude of glass beads. Optionally the particles may comprise fine particles such as talc. The particles 38 would not completely fill all void space within the seal element 34, rather room is left between the particles to allow inward and outward flexing of the seal element 34.

Another optional embodiment of the seal assembly **30*a* is provided in cross sectional view in FIG. 3. In this embodiment, a pressure vent 37 is shown formed through the wall 39*a*. The pressure vent allows equalization of the pressure within the seal element 34*a* and the surrounding area. This may be useful in situations when the area surrounding the seal element 34*a* may experience a pressure increase during use. If the pressure in the seal element 34*a*** is substantially lower than its surrounding environment, the unequal pressure distribution may prevent it from expanding into sealing engagement as needed.

The seal element 34 may be formed by combining together two metal W seals, the W seals may be seam welded along their edges at a line of symmetry. Additionally, the apex of the corresponding upper and lower portions 40, 42 may include added support for accommodating the presence of the ring members 32.

The member 32 may comprise other embodiments. For example, the cross section may resemble that of a triangle having rounded edges as well as a semi-circular member, where the apex of the semi-circle protrudes into the inverted portion of the seal 34. In order to ensure proper sealing engagement of the seal member 34, the design of the seal 34 should maintain an axial clearance between the apex of the inverted portions, even under related conditions.

It is to be understood that the invention is not limited to the exact details of construction, operation, exact materials, or embodiments shown and described, as modifications and equivalents will be apparent to one skilled in the art. For example, the seal element 34 may have a single side that is inverted and not both sides. Additionally, the inverted space may comprise a generally rectangular cross section and be positioned at any radial location on the outer surface of the wall 39. The seal may be used in many other applications other than on an isolation sleeve of a wellhead assembly. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

What is claimed is:

1. A seal assembly for sealing between inner and outer tubular members, comprising:

an annular seal having a flexible, resilient wall of metal that defines a hollow interior;

the wall having an inner portion that is convex for sealing against an inner surface of an outer tubular member;

the wall having an outer portion that is convex and spaced opposite from the inner portion for sealing against an outer surface of an inner tubular member;

the wall having a first end portion joining the inner and outer portions and a second end portion joining the inner and outer portions opposite the first portion;

an inverted portion formed in the wall between the first end portion and second end portion defining shoulders in the wall on opposing sides of the inverted portion; and a conforming member coaxial with the seal having a base portion in contact with the shoulders and a support member projecting from the base into supporting contact with the middle area of the inverted portion.

2. The seal assembly of claim 1 wherein the tubulars comprise wellhead assembly components.

3. The seal assembly of claim 1 wherein the conforming member comprises a first conforming member, the seal assembly further comprising a second conforming member disposed on a side of the seal opposite the first conforming member.

4. The seal assembly of claim 1, wherein the first end is selected from the group consisting of the upper portion of the seal and the lower portion of the seal.

5. The seal assembly of claim 1, wherein the support member has a configuration selected from the group consisting of an elongated rectangle, a triangle, and a hemisphere.

6. The seal assembly of claim 1 further comprising a vent formed through a wall of the annular seal.

7. The seal assembly of claim 1 further comprising solid particles disposed in the annular seal with voids provided between at least some of the solid particles.

8. The seal assembly of claim 1, wherein the seal is formed from a pair of W shaped annular rings joined at a line of symmetry along the inner side wall and the outer side wall.

9. A pressure energized seal assembly for sealing between a tubular and a corresponding member, the seal assembly comprising:

an annular seal having a flexible, resilient wall of metal that defines a hollow interior;

the wall having an inner portion that is convex for sealing against an inner surface of an outer tubular member;

the wall having an outer portion that is convex and spaced opposite from the inner portion for sealing against an outer surface of an inner tubular member;

the wall having a first end portion joining the inner and outer portions and a second end portion joining the inner and outer portions opposite the first portion;

an inverted portion formed in the wall between the first end portion and second end portion defining shoulders in the wall on opposing sides of the inverted portion; and a conforming member coaxial with the seal having a base portion in contact with the shoulders and a support member projecting from the base into supporting contact with the middle area of the inverted portion.

10. The seal assembly of claim 9 wherein the conforming member comprises a first conforming member, the seal assembly further comprising a second conforming member configured for engaging the lower inverted portion and transferring pressure from a pressure source to the lower inverted portion.

11. The seal assembly of claim 9, wherein the first end is selected from the group consisting of the upper portion of the seal and the lower portion of the seal.

12. The seal assembly of claim 9 further comprising a vent formed through a portion of the annular element.

* * * * *